United States Patent [19]

Befort

[11] Patent Number: 4,542,563

[45] Date of Patent: Sep. 24, 1985

[54] END RELEASE BUCKLE

[75] Inventor: Horst U. Befort, Midland, Canada

[73] Assignee: TRW Automotive Products, Inc., Ohio

[21] Appl. No.: 509,143

[22] Filed: Jun. 30, 1983

[51] Int. Cl.[4] ..... A44B 11/25

[52] U.S. Cl. ..... 24/641; 24/645

[58] Field of Search ..... 24/640, 641, 642, 643, 24/645, 636, 637, 638, 639

[30] Foreign Application Priority Data

Feb. 18, 1983 [CA] Canada ..... 421932

[56] References Cited

U.S. PATENT DOCUMENTS

| | | | |
|---|---|---|---|
| 3,131,451 | 5/1964 | Fisher | 24/230 |
| 4,004,115 | 1/1977 | Esner | 24/641 |
| 4,069,557 | 1/1978 | Loomba | 24/230 |
| 4,136,425 | 1/1979 | Esner | 24/641 |
| 4,237,586 | 12/1980 | Morinaga | 24/230 A |
| 4,310,954 | 1/1982 | Lewis et al. | 24/230 A |
| 4,353,151 | 10/1982 | Ennerdal | 24/641 |
| 4,358,877 | 11/1982 | Burke | 24/641 |
| 4,358,879 | 11/1982 | Magyar | 24/641 |
| 4,388,746 | 6/1983 | Krautz et al. | 24/645 |
| 4,391,024 | 7/1983 | Morinaga | 24/637 |
| 4,454,634 | 6/1984 | Haglund et al. | 24/645 |

*Primary Examiner*—William E. Lyddane
*Assistant Examiner*—Peter A. Aschenbrenner
*Attorney, Agent, or Firm*—Yount & Tarolli

[57] ABSTRACT

An end release type of buckle for safety belt harness in vehicles and a method of assembly wherein a channel shaped elongate chassis transversely supports a latch and a latch blocking element, the latter pivotal at one end and biased toward blocking the latch. A closure plate biased to follow insertion and removal of a buckle tongue is reciprocably mounted for longitudinal movement to the web of the chassis. A release slider is provided which reciprocates to remove the blocker against its bias and to depress or open the latch. A tubular case encloses and detentably assembles the chassis and operably guides the release slider while supporting the operating bias applying elements. A cup-like cover is pressed longitudinally over the case and is detentably located and secured to said case. When not in use the latch is held open by the closure plate. When a tongue is pressed into the buckle the closure plate retreats from blocking the entry slot and the latch obeys the bias to lock. Upon locking the tongue, the blocker bar secures the latch against withdrawal until the release slider depresses the latch after tilting the blocker bar away from the latch.

37 Claims, 12 Drawing Figures

END RELEASE BUCKLE

The present invention is a new and improved vehicle safety harness buckle of the end release type having principal utility as a terminal connection for safety belt harness in which it is desired to insert a webbing or belt tongue into the proferred or anchored buckle element in a single movement and subsequently permitting ejection release of the tongue by pressing a release slide portion of the buckle in a direction paralleling the direction of tongue entry. The present invention is directed to a simple assembly in which strength is derived from the interlocking of tongue to channel chassis or frame by means of a latch depressed upon entry of the tongue and the locking of the latch element prevents withdrawal of the tongue and a transverse pivoting blocking bar thereupon blocks the release of the latch. The entry of the belt tongue displaces a closure plate and loads an ejection bias which acts upon ultimate release of the latch and substantially simultaneous withdrawal of the pivotal blocking bar. The coordination of these two actions occurs upon pressing the release slider in a direction paralleling the entry and withdrawal direction of tongue movement at the tongue entry end of the buckle.

The novelty of the construction of the present invention exists in the provision of a transverse pivoting latch blocking bar coordinated in release with the unlatching movement of the release slider acting on both latch and pivotal blocking bar. The construction also provides a closure of the entry aperture when the buckle is not in use in prevention of the entry of dirt and debris into the mechanism. Novelty is also found in the use of detenting case and cover elements in relation to each other and the chassis or frame. Novelty and invention is inherent in the provision of a substantially automatic procedure for assembly of end release type buckles which is both simple and accurate. Finally, the structure permits and admits of precision molding in plastic materials of principal movement control elements in substantial integration of parts while providing in the assemblage new potentials for decorative external treatment. Only the stress conducting elements and the bias means are made from metal. The frame, latch and blocking bar are metal stampings. The considerable elimination of metal is observable in this type of buckle without sacrifice of strength and durability. Upon assembly the buckle of the present invention is relatively tamper-proof and any attempts to enter the structure after assembly leave telltale evidence. The compactness of this buckle allows a sizing to accommodate seating in smaller vehicles.

Thus, the objects of the new and improved end release buckle can be summarized as including a novel construction allowing simplified assembly, compactness, surety against entrant debris, integration of parts in lightweight plastic molded structures, transverse pivotal blockage of the latch in locking position and increased accuracy and dimensional control. Benefits are found in economy, serviceability, and adaptability to down-sizing while providing easy release and good kick-out characteristics at low release pressures.

BACKGROUND

The closest known background art is found in the U.S. Pat. No. 3,131,451 to Robert C. Fisher in which a vastly simplified buckle responding to push button or lift lid actuation was proposed; U.S. Pat. No. 4,069,557 of Yogendra S. Loomba was directed to an end release structure having laminar construction but included a latch blocking lift structure; U.S. Pat. No. 4,237,586 of Massaru Morinaga in which an end release buckle is shown having a latch straddling a tongue element and the latch is cammed upward by depression of the release element; and U.S. Pat. No. 4,310,954 of John W. R. Lewis and Mark E. Esner in which a two-piece molded cover operably houses a hook shaped element in a plane perpendicular to the frame or chassis and by means of which the slider 5 releases or locks the latch. The present invention is regarded substantially creative over the constructions there presented and as will be seen as the description proceeds.

IN THE DRAWINGS

Figure 6:
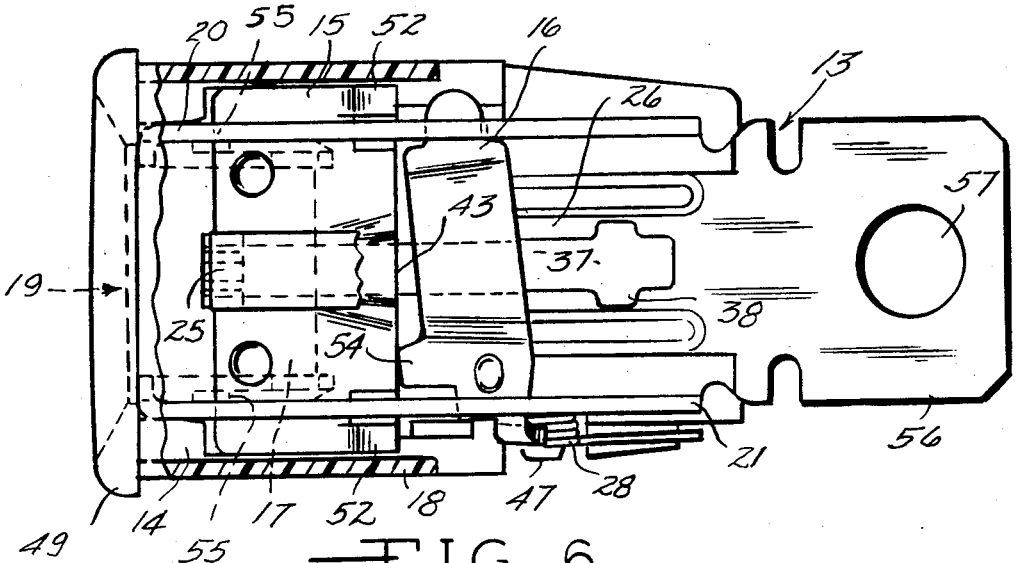
FIG. 6 is an enlarged bottom plan view of the structure of FIG. 5 and partially cut away to reveal the latch construction and indicating in phantom line the biased blocking position of the transverse blocking bar. In full line the blocking bar is swung under the latch in prevention of unlocking of the latch as by chance.
Figure 7:
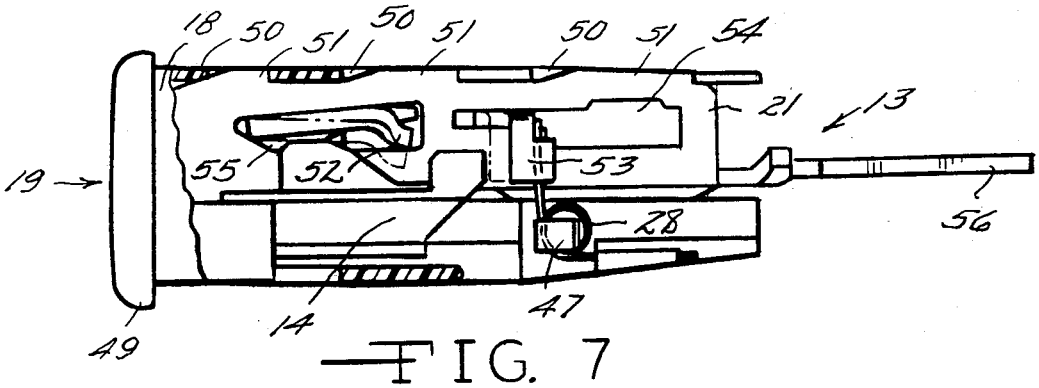

FIG. 7 is a side elevation view of the structure of FIG. 6 with the case partially cut away to indicate the release slide lug surfaces and their interference engagement relation to the latch and transverse blocking bar. For the latch the phantom line indicates the locked position and for the blocking bar the phantom line shows the lock blocking position. The torsion spring is shown operably assembled and applying a bias seeking to position the transverse blocking bar in its blocking position.

Figure 8:
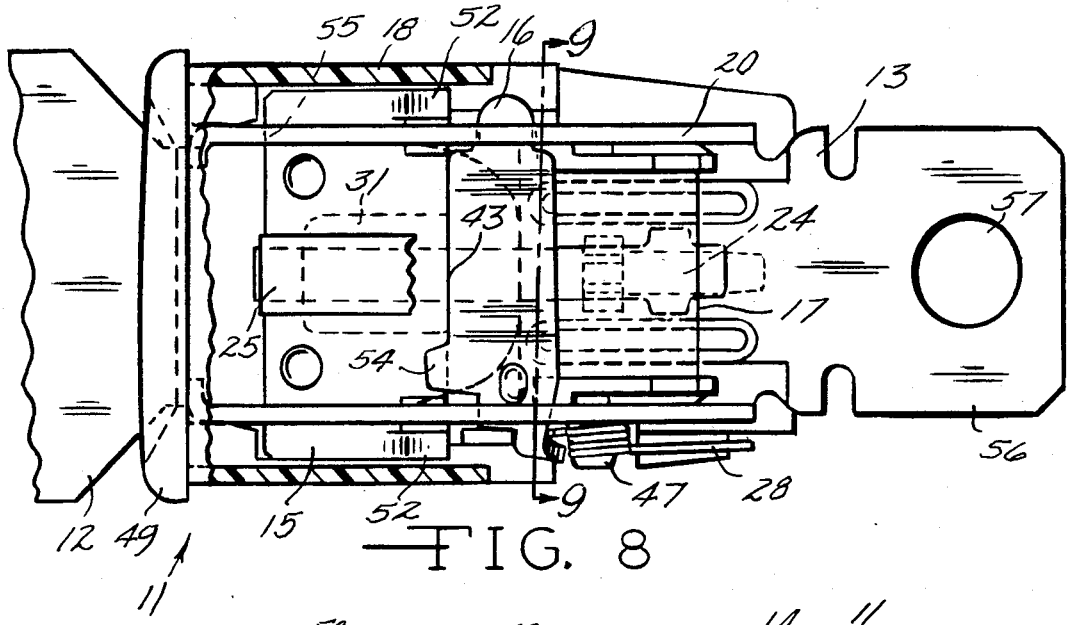

FIG. 8 shows a partially cut-away bottom plan view of the structure of FIG. 7 and with the transverse blocking bar under the latch with the tongue inserted and locked. A portion of the latch spring is visible and the torsion spring is fully visible.

Figure 9:
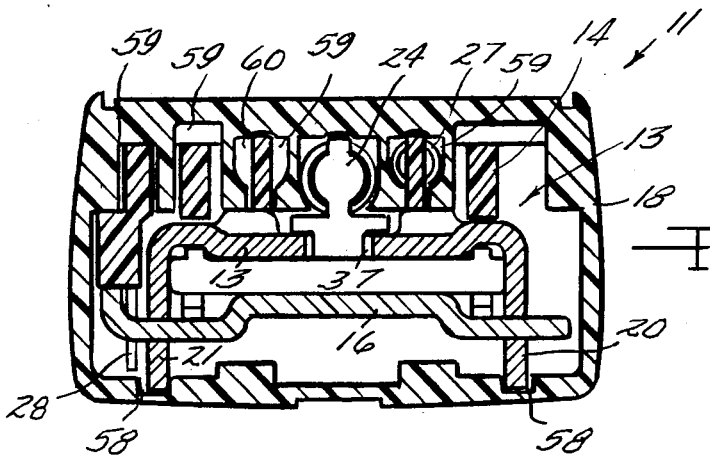

FIG. 9 is a full section elevation view taken on the line 9—9 through FIG. 8.

Figure 10:
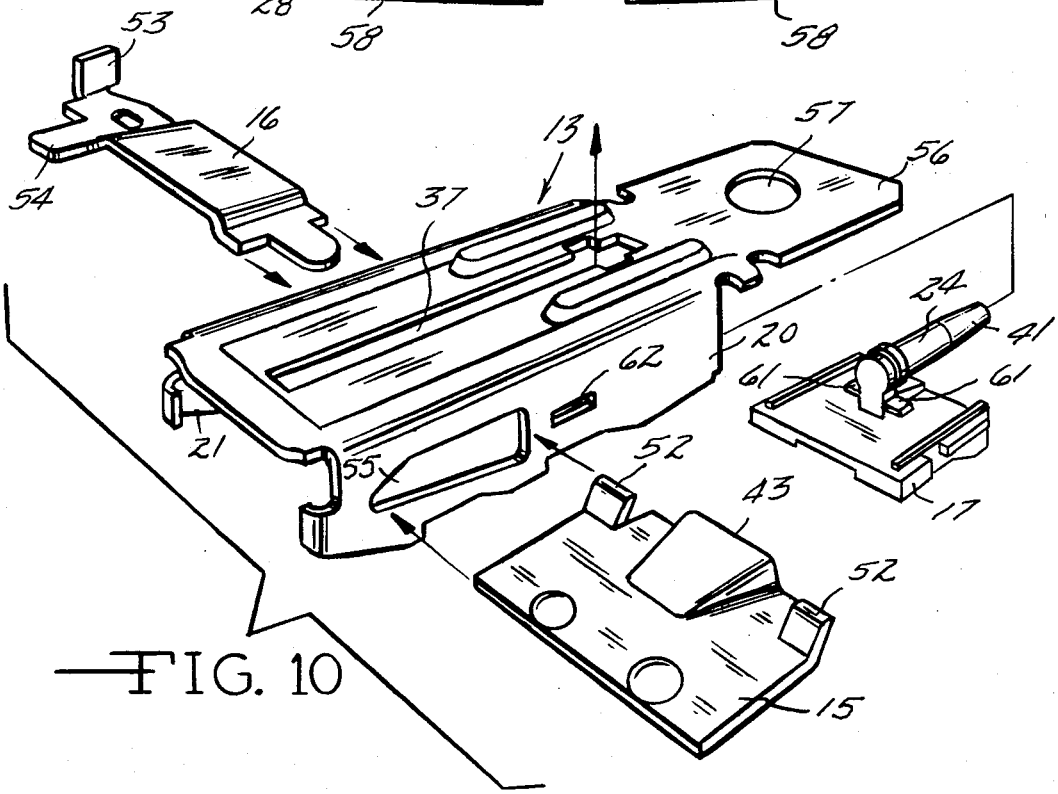

FIG. 10 is an exploded perspective view of the assembly of elements in and to the chassis.

Figure 11:
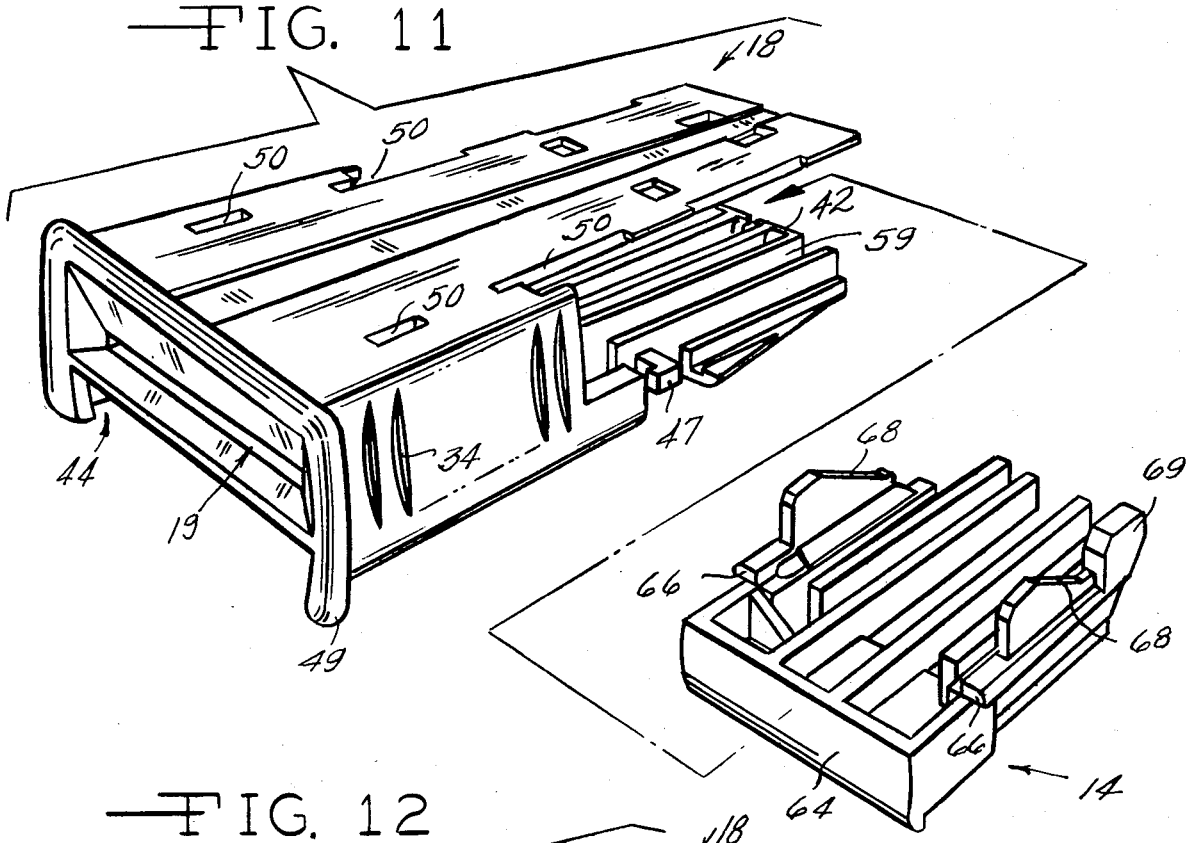

FIG. 11 is an exploded perspective view of the case and release slider as inserted in the case.

Figure 12:
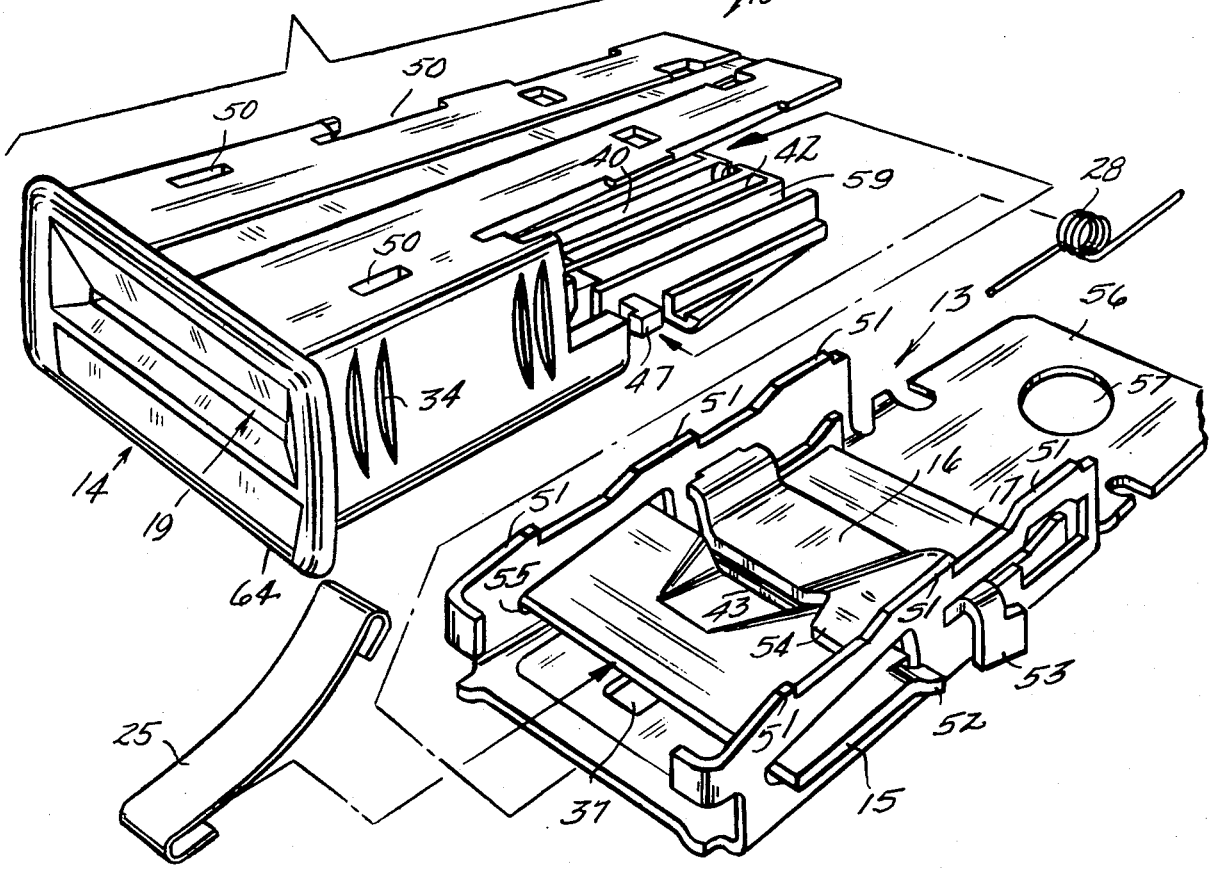

FIG. 12 is an exploded perspective view of the assembly of the chassis subassembly insertable in the subassembly of the case and slide release and indicating the attachment of the torsion spring preliminary to insertion of the coil springs in their guideways and tracks through the case.

GENERAL DESCRIPTION

In general, the present structure is unique in providing a molded substantially tubular case which, upon pressing the case longitudinally over the chassis or frame and the case, detents into position while providing assembly and track guiding accommodations for the release slide. The plastic molded case includes a front slot aperture for entry of the tongue element and a separate top opening through which the release slider projects. The case and the release slider are indexed and dimensionally coordinated by the detent relation of the case to the chassis and by the tracks in the case guiding the slider. The chassis is channel-like and the upstanding flanges include tooth-like ramped lugs detenting into corresponding slots provided in the case. This occurs upon insertion of the chassis together with the transverse elements of latch and blocking bar (located in suitable apertures in the flanges) and with the closure plate and its spring retainer in the track provided longitudinally in the web or base of the chassis. The latch includes a spring element which acts upon the latch urging it into a locked position. Coil springs are inserted in molded guide paths provided in the case. The central longitudinal coil spring or ejection spring applies an operative bias against the closure plate. This is a bias overcome by entry pressure of the tongue and thus provides an ejection force against the tongue when the latch is disengaged from the tongue. The outboard parallel coil spring, also guided by the case and the release slider, biases the release slider element to a normal slide stop position against the case. The case is provided with buttress surfaces for the coil springs and with entry slots for the coil springs and provides simple assembly without complex assembly tooling. When it is desired to release the latch from a buckle tongue, the outboard coil spring permits lineal movement of the release slider. A torsion spring is attached to the case and to the pivotal blocking bar. The pivot connection to the bar is at the side of the chassis opposite the torsion spring. This applies a blocking bias to the pivotal blocking bar so as to normally prevent unlocking of the element. The release slider includes a pair of spaced-apart projecting surfaces which are, respectively, in interference relation with the operating lugs on the ends of the latch and with the lug on the movable end of the blocking bar. As the release slider is depressed, the projecting interference surfaces depress the lugs and upon predetermined movement, pivot the blocking bar from under the latch and then the latch is forced away from lock engagement with the latch aperture in the tongue. As that occurs, the thrust of the ejection spring, urging following engagement with the tongue, kicks out the tongue and closes the tongue aperture slot in the case. The web portion of the chassis at the end opposite the tongue entry includes connecting means for attachment to suitable terminal anchorage hardware. The flank portions of the case include gripping serrations, ramped in the direction of the tongue entry and forming abrupt abutments or stops at the sides of the serrations opposite the tongue entry direction These provide simple and precision detent retention when the outside decorative cover or shell is pressed longitudinally over the case and its contained assembly. The cover shoulders finally and firmly against perimeter bead portions of the case blocking further movement of the cover while the cover and its integral detent lock protrusions grip firmly against the registering serrations in the case. The simple steel stampings are the chassis, latch and blocking bar. But for the springs, the balance of the device is in injection molded high impact and dimensionally stable plastic material.

SPECIFIC DESCRIPTION

Figure 1:
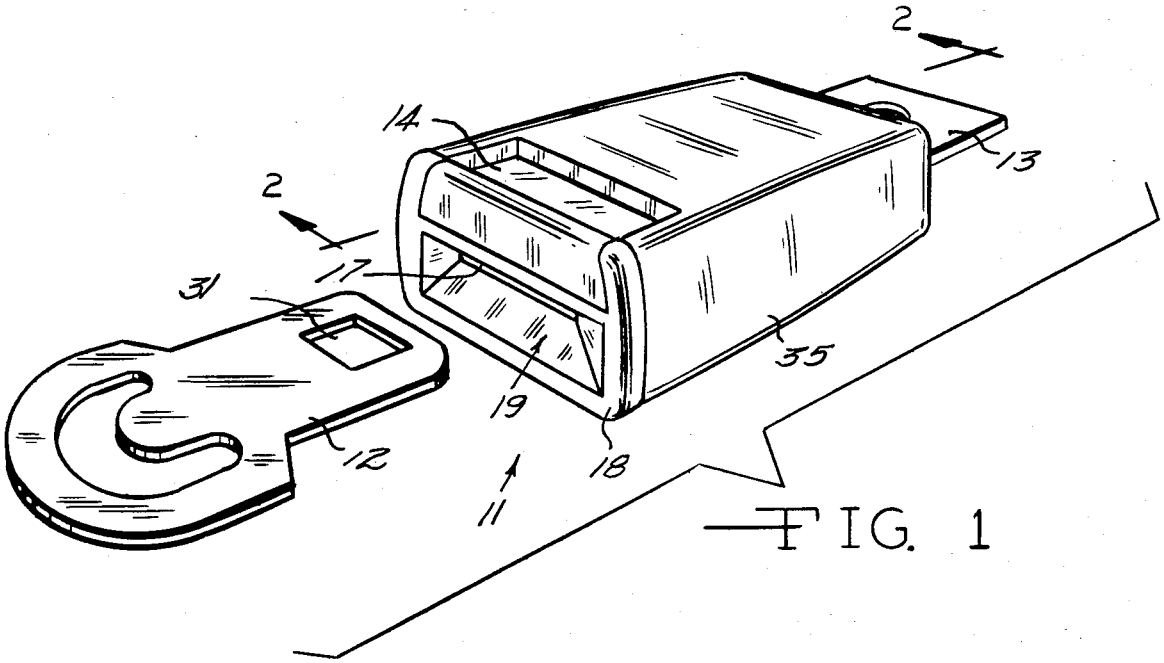
FIG. 1 is a frontal perspective composite view of a safety harness tongue element in relation to entry into or ejection from an end release buckle in accord with the present invention.

Referring to the drawings and with first reference to the FIG. 1 thereof, the buckle 11 and tongue 12 of the present invention are seen. The channel chassis or frame 13 is visible only as a tail part extending from the generally cup-like outer cover 35. The outer cover 35 tapers slightly to the rear and an opening is provided through which proceeds the chassis 13. At the upper end the cover 35 abuts the trim bead of the tubular case 18. The case 18 includes and defines the front aperture 19 which receives the tongue 12. The closure plate or ejector member 17 closes the aperture 19 when the tongue is not inserted in prevention of the intrusion of dust, dirt and debris. The tongue 12 is usually connected to safety belt harness (not shown) and the tongue 12 is slotted to receive harness web belting (not shown). The case 18 also includes an opening through which the plastic release slider 14 operably protrudes. When the release slider 14 is depressed, the tongue 12 is released and ejected from the buckle 11. At this point it should be appreciated that the chassis 13 is inserted in the tubular case 18 and then the tubular case 18 is inserted in the slightly tapered cover 35 and that the resulting assemblage is detented together in a dimensionally controlled and indexed manner. The mechanism in the chassis 13 closes upon the tongue 12 upon insertion of the tongue 12 and locks the tongue 12 against withdrawal by engaging the lock aperture 31.

Figure 2:
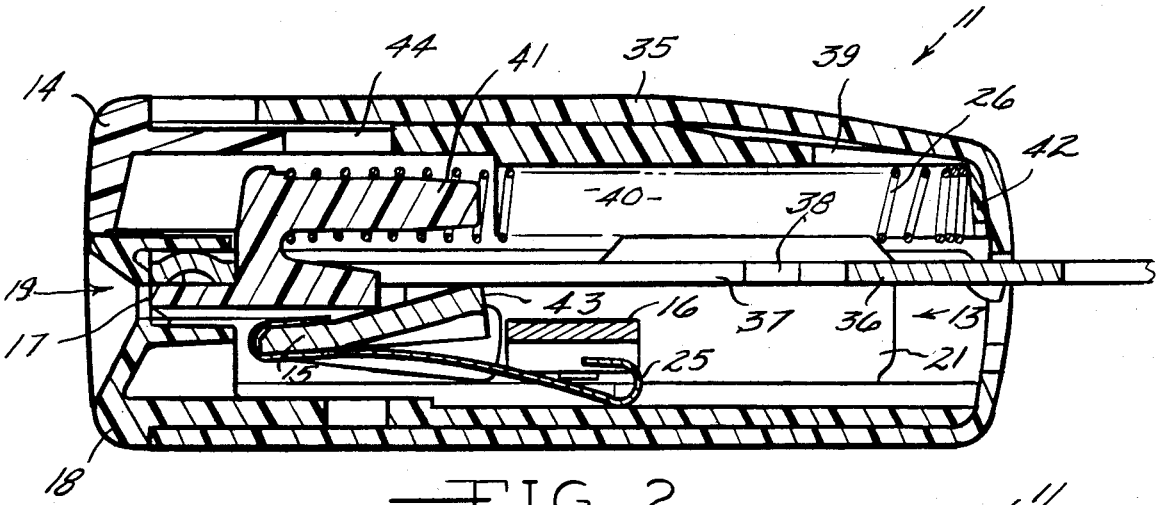
FIG. 2 is a full longitudinal cross section elevation view taken on the line 2—2 of FIG. 1 and indicating the end release buckle empty but with the entry aperture slot closed by a closure plate.
Figure 3:
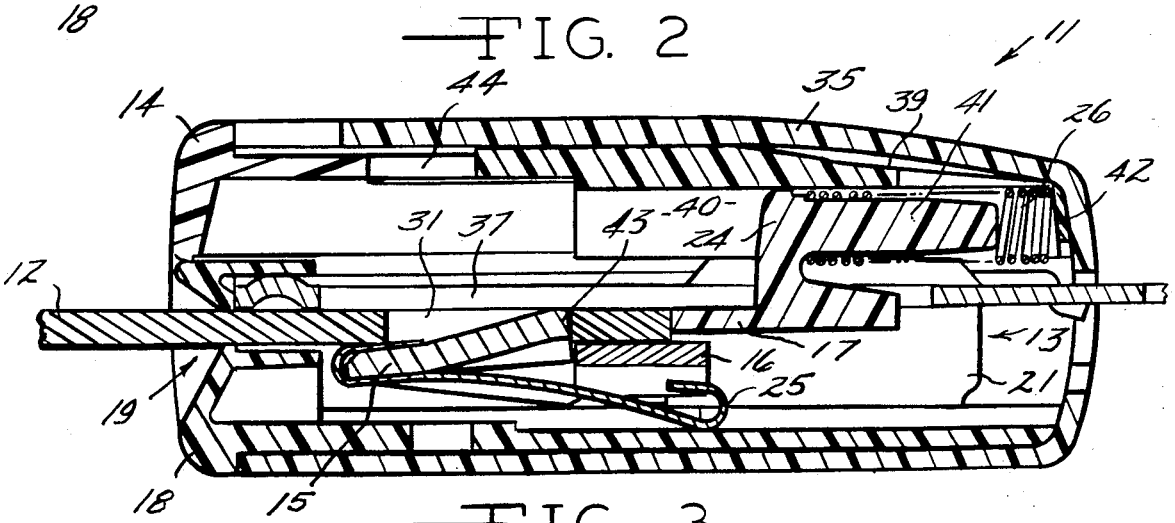
FIG. 3 is essentially the same cross section view as seen in FIG. 2 but indicating the positioning of the tongue at full entry loading the ejector spring with the latch elevated to the lock position.

In FIG. 2 the described construction is made clearer. The chassis 13 is generally channel-shaped and includes spaced-apart flanges 20 and 21 extending from the longitudinal web 36. The web 36 includes a longitudinal center slot 37 running substantially the length of the web 36. A cross access opening 38 expands the slot 37 toward the rear of the chassis 13 so that the closure plate 17 is connectable for guided reciprocation in the slot 37 by pressing the spring retainer cylindrical element 24 through the opening 38 and into an operative running fit in the slot 37. The coil spring 26 loaded through the spring aperture 39 of the case 18 traverses the central longitudinal spring slot 40 in the case 18 and is guided over the tapered nose portion 41 of the spring retainer 24 extension of the closure plate or ejector member 17. The spring 26 normally biases the closure plate 17 closed as noted. Upon insertion of a tongue 12 the closure plate moves to the right as shown in the FIG. 2 and hence the spring 26 may be regarded as an ejector spring as well as a closure spring. The rear wall of the spring guide in the case 18 forms a thrust buttress 42 against which the coil spring 26 bears. The latch 15 is pivotally supported in hinge apertures provided through the flanges 20 and 21 of the chassis 13. The latch 15 is normally biased to the closed or lock position against the web 36 of the chassis 13 and in an interference path with any tongue 12 inserted in the front slot aperture 19. The bias is achieved by a spring 25 seen as a flat spring acting between case 18 and latch 15. When the opening 31 in tongue 12 is in register with the latching face 43 of the latch 15, then the tongue 12 is locked against removal. Such a situation is seen in the FIG. 3 and the closure plate 17 has been moved by the tongue 12 to the rear of assembly in depression of a spring 26. The pivotal blocking bar 16 runs transversely across the chassis 13 pivoting at one end in a slot through one flange and permitting lineal movement in the other flange of the flanges 20 and 21. An intermediate blocking plate lug extends from the blocking bar 16 and it is biased, as will be seen, to a position beneath the latch 15 securing the latch 15 against unlocking except upon insertion of a tongue 12 and upon lineal movement of the release slider 14. These actions cause pivotal movement of the blocking bar 16.

Figure 4:
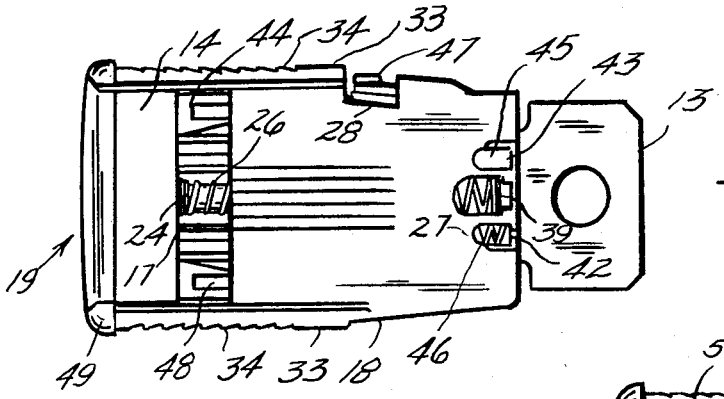
FIG. 4 is a top plan view of the structure seen in FIGS. 2 and 3 but without the tongue and indicating the encircling or tubular case surrounding the chassis or frame and the saw tooth serrations in the case are visible to engage and fix the cover upon assembly.

FIG. 4 is a top view of the buckle 11 without the cover 35 with all parts enclosed by the tubular case 18. The general rearward taper of case 18 is observable and ramped serrations 34 in the flanks 33 of the case 18 can be seen. The release slider 14 is indicated and through the central gap 44 the spring retainer 24 is visible with the central longitudinal or ejector spring 26 on the nose portion 41. At the rear end of the case 18 the central spring aperture 39 provides access to the spring 26 for assembly and disassembly and the wall 42 provides a thrust buttress in the case 18. The aperture 39 leads into the elongate spring guide or channel 40. The two adjacent parallel openings 45 and 46 allow access for location of the outboard coil spring 27, shown selectively in the opening 46 and against the thrust buttress of rear wall 42. Also visible is the hanger post 47 for the torsion spring 28 and the function of a torsion spring will become clearer as a description proceeds. In general, the torsion spring 28 urges the transverse pivotal blocking bar 16 under the latch 15. The spring 27 runs in a pocket formed in the case 18 to press against the inner wall of the release slide 14 and biasing the release slider 12 outwardly on its guide tracks 48 and against the stop of the apertured end of the case 18. The saw tooth serrations 34 in the flanks 33 of the case 18 will be seen to lock against the interior of the cover 35 in prevention of withdrawal of the cover 35 once assembled by axially pressing the cover 35 over the case 18 to stop engagement against the shoulder bead 49 of the case 18.

Figure 5:
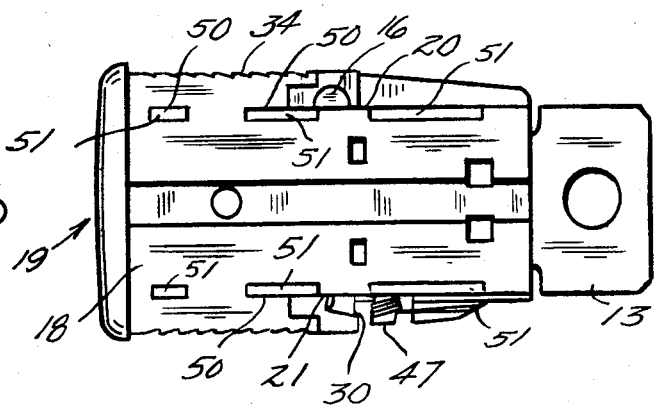
FIG. 5 is a bottom plan view of the structure seen in FIG. 4 and torsion spring between case and blocking bar is best visible along with the detent slots mooring the assembly in the chassis to the case.

FIG. 5 provides an assembled bottom view of the case 18 and the blocking bar 16 is visible protruding from the flange 20 where it rocks or pivots and the operating lug 30 of the bar 16 protrudes from the flange 21 and engages the torsion spring 28 mounted on the post 47 extending from the case 18.

The slots 50 are in detenting alignment with tooth-like ramped extensions 51 (best seen in FIG. 7) on the longitudinal edges of the flanges 20 and 21. This permits the chassis 13 to be driven into the case 18 against the end stop of the case 18 and upon the precise registry of teeth 51 to slots 50, the case 18 is secured to the chassis 13 in a manner not visible from the covered construction. The plastic case 18 is sufficiently resilient to be flexed by the teeth 51, on insertion of the chassis and then returned to grip the teeth 51.

FIG. 6 removes a portion of case 18 to better reveal the chassis 13, the transversely located latch 15. The pivotal blocking bar 16 spanning between the flanges 20 and 21 is also seen. The flat latch spring 25 is partially visible at its connection to the latch 15 and the latching face 43 is seen urged against the web 36 of the chassis 13. The pivotal extremes of the blocking bar 16 are visible, the normal position of bias is in phantom line beneath the latch 15.

In FIG. 6 the plastic closure plate or ejector member 17 is fully extended to close the front slot tongue aperture 19 and it remains in this position until entry of a tongue 12 through the aperture 19. In the position, as indicated, the blocking bar 16 is prevented from sliding under the latch 15 because the closure plate 17 prevents the latch 15 from closing. Since the closure plate 17 acts against the bias of the latch, the buckle 11 is quiet and relatively rattle-free. The Figure 7 with the case 18 cut away reveals the release slider 14 in interference relation (upon reciprocation) with the lift tabs 52 of the latch 15 and with the operating lever 53 of the blocking bar 16. The opening 54 in the flange 21 of chassis 13 allows simple assembly of the blocking bar 16 to the chassis 13 so as to permit the bar 16 to pivot on the slot opening in the opposite flange 20 in accord with the bias applied by the torsion spring 28 to the blocking bar 16. The spring hanger 47 is visible.

The FIG. 8 shows the blocking bar 16 in the blocking position at the locked position of the latch 15, the lug-like blocking extension 54 of the bar 16 is located beneath the latch 15 so that it cannot move from its locked position until selected release. The closure plate 17 is fully traversed against the spring 26 and is in following contact with the tongue 12. The latching face 43 of the latch 15 is firmly inserted into the lock aperture 31 in the tongue 12 and all stresses under lock conditions are thrown to the chassis 13 at latch hinge apertures 55 in the flanges 20 and 21. The stresses travel through the chassis 13 and to the tailpiece 56 where they are anchored as to the frame of a vehicle, for example, at the connection accommodated by the anchor opening 57 in the chassis 13.

The transverse section through FIG. 8 provides an end view assembly relationship in which the parts assembled in the tubular case 18 are related to longitudinal channel track guiding means provided by the case 18 for the release slider 14 and the chassis 13 in respect to the blocking bar 16 and closure plate 17. Longitudinal tracks 58 in the case 18 control the precision location of the chassis 13 at entry to the case 18. The longitudinal tracks or grooves 59 in the case 18 provide the same precision guiding of the release slider 14 in its selected reciprocal movement against the outboard coil spring 27. The central longitudinal aperture or slot 37 in the web portion 36 of the chassis 13 is shown. The vacant spring guide channel 60 allows for alternate location of outboard spring 27.

By reference to the FIGS. 10, 11, 12, the simplicity of assembly of the described structure can be readily appreciated. In FIG. 10 the chassis or frame receives the closure plate 17 at the cross access opening 38 in the slot 37. The nose portion 41 of the spring retainer 24 of the closure plate 17 maintains its closure posture through its entire travel in the full assembly of the end release buckle 11. The latch 15 is inserted in the hinge apertures 55 of the flanges 20 and 21 of the chassis 13 and the addition of the flat latch spring 25 (FIGS. 2, 3, and 6) assures the constant bias of the latching face 43 toward the lock direction. The outboard lift tabs 52 extending beyond the flanges 20 and 21 provide operating control means for the latch 15. When the buckle 11 is empty, the closure plate 17 holds the latch 15 open until the closure plate 17 moves past to allow registry of latch opening 31 in tongue 12 with the latch face 43. Then the latch 15 obeying the force from spring 25 pops upward.

The blocking bar 16 is inserted to extend transversely across the chassis 13 pivotal at one end in the slot 62 in the flange 20. Assembly is through an access opening 63 in the flange 21 and is better seen in FIG. 12. The blocking extension 54 is extendable under the latch 15 in obedience to the urging of the torsion spring 28 acting against the operating lever 53 of the blocking bar 16. While the closure plate 17 depresses the latch 15 to the unlocked position, the blocking bar 16 cannot get beneath the latch 15. However, upon locking against a tongue 12 as previously described, the lock bar blocking extension 54 is driven into blocking position securing the latching of the tongue 12.

The assembly of FIG. 10 in chassis 13 is prepared for loading into the tubular cavity of the case 18 directly after the release slide 14 is precision inserted in the case 18 by tipping in the pressure tab handle portion 64 through the top opening 44 in case 18 seen at front aperture 65 through the case 18 as seen in FIG. 11. The wing extensions 66 in the release slider 14 act as stops in the assembly, the rails 67 guide and coordinate the plunger-like movement of the release slider 14 in the registering tracks or grooves 59 in the case 18. The control surfaces 68 and 69 on the release slider 14 coordinate the unlocking movement of the blocking bar 16 and the depression or release of the latch 15 from latching engagement. The ramped surface 68 achieves release of the latch 15 after pivotal withdrawal of the blocking bar 16.

In the FIG. 12 with the release slider 14 in place in tubular case 18, the previously described assembly in the chassis 13 is longitudinally insertable in the open end of the tubular case 13. The ramped teeth 51 deform the case 18 on entry of the chassis subassembly as shown, and guided by the tracks in the case 18. Upon full insertion the teeth 51 register with the openings 50 and the plastic case 18 snaps into detent holding relation. The torsion spring 28 is positioned over the hanger post 47 and one end engages the case 18 and one end acts against the operating lug 53 of the bar 16 and the other end against the case abutment to apply the blocking bias to the bar 16. The coil springs 26 and 27 are inserted through the openings 42 and 45, respectively, in the case 18 (FIG. 4) guided internally of the case 18 to respective abutment against the closure plate 17 and the release slider 14 and against the transverse wall 42 of the case 18. Then, over the whole of the subassembly, the cup-like matching cover 35 (FIG. 1) is longitudinally pressed to engage the stop of perimeter bead 49 in case 18 and in detent engagement against the flank serrations 34 in both sides of the case.

In operation, the buckle performs well and quietly since the applied biases assure that the moving elements will not rattle and because of the plastic to metal interfacing using tubular telescoping or nesting relationship of the subassemblies. The slight taper of the buckle 11 toward the anchor end enhances the detent stacking assembly of chassis subassembly in case subassembly and then is closed or wrapped in detent relation by the outer and selectively decorative plastic cup-like or sleeve cover.

The precision molded guides and tracks assure smooth functioning of parts and strength is available in the metal portions transmitting stresses as needed well above present safety requirements.

The case, cover, release slider, and closure plate are made of a plastic, that is, polymeric, material which complements performance and elegance with minimum weight and cost and at a repetitive precision available in injection molding at high production rates. The metal portions of the chassis, latch and blocking bar are stamped and pierced as shown using relatively simple tooling and at low cost and high production. In testing, the presently described buckle in its preferred embodiment shows good performance and especially good and low release pressures at very high holding performance. Assembly is simple, procedurally, and efficient. It is very amenable to automated or robotic assembly.

Having thus described my invention those skilled in the art will appreciate changes, improvements and modifications and such changes, improvements and modifications are intended to be included within the spirit of the invention limited only by the scope of my hereinafter appended claims.

I claim:

1. An end release type buckle for safety belts comprising:

a channel shaped chassis having a web portion and flanges;

a latch pivotal in said chassis and biased toward a closure position;

a blocking bar pivotal transversely of said channel and biased toward blocking said latch in the closure position;

a tubular case detentably receiving said chassis, said latch and said blocking bar from one end;

a release slider reciprocal longitudinally of said chassis and biased against one end of said case and having an interference relation in movement first with said blocking bar and then with said latch whereby said latch is driven to the open position and said blocking bar is moved from blocking relation to said latch; and a closure plate biased toward said one end of said case and movable by insertion of a buckle tongue into said case, said closure plate preventing said blocking bar from blocking opening movement of said latch until said closure plate is displaced from its biased position.

2. An end release type buckle for safety belts as set forth in claim 1 and including an outer cup-like cover detentably locking over said tubular case against removal.

3. An end release type buckle as set forth in claim 1 wherein said tubular case includes internal longitudinal guide track means for said release slider and said closure plate and at one end defines a tongue entry aperture normally closed by said closure plate.

4. An end release type buckle as set forth in claim 2 wherein said chassis includes ratchet-like teeth ramped in one direction and said tubular case includes registering slots into which said teeth project upon insertion of said chassis in said case, said case deflected upon entry by said ramped teeth at insertion of said chassis to register with said teeth and flanking serrations external of said case detentably and lockably receiving said cup-like cover.

5. An end release type buckle for safety belts comprising:

a metal chassis in the form of an elongate channel having apertured flanges and a longitudinally slotted web, said web including an extending tailpiece;

a metal latch insertable through and pivotal on said flanges of said chassis and including a bias element urging said latch toward a closure position against said web portion of said chassis, said latch ramped for depression by an inserted tongue and sized to lockably enter an opening through said tongue upon registering therewith;

a metal blocking bar pivotal on one of said flanges of said chassis and lineally movable in the opposed flange and biased toward blocking said latch in said closure position;

a plastic tubular case having a tongue entry slot at one end and secured over said chassis by detent means;

a plastic release slider through said case selectively depressible and reciprocable in respect thereto and said release slider including control surfaces sequentially engaging said latch and said blocking bar whereby said blocking bar is driven out of blocking engagement with said latch and said latch is released, said release slider biased toward engagement with said apertured end of said case;

a plastic closure plate reciprocal in said longitudinal slot in said web of said chassis and biased to close said end aperture in said case and said closure plate in said biased position in interfering contact with said blocking bar in prevention of blocking movement;

coil springs arranged in said case one applying said bias to said closure plate and the other applying said bias to said release slider;

a torsion spring on said case applying said bias to said blocking bar;

a flat spring applying a pivotal bias to said latch toward said closure position; and an outer plastic cover pressed over said case and detentably secured thereto.

6. The process for assembly of an end release buckle for safety belts including the steps of:

transversely inserting a latch with spring and a latch blocking bar through apertured flanges of a chassis and longitudinally and guidably attaching a closure plate by means of a longitudinal slot in a web of said chassis to form a chassis sub-assembly;

longitudinally loading an elongate tubular internally tracked case by insertion of a slider indexed through an opening in one end of said case to form a case sub-assembly;

longitudinally inserting said chassis sub-assembly in said case sub-assembly and against said one end of said case guided by tracks and stops in said case and whereby upon insertion said sub-assemblies detent together;

applying a torsion spring to said case, one arm acting against said latch blocking bar and the other acting against said case; and applying cup-like cover longitudinally over said assembled sub-assemblies one end abutting said case and the other end open and through which extends a tailpiece anchor portion of said chassis, said cover detenting to said case sub-assembly upon full insertion.

7. An end release buckle for receiving and latching a tongue of a safety belt therein, said buckle comprising:

a channel-shaped chassis having a web portion and flanges, a latch mounted in said chassis and biased toward a closure position in which it latches the tongue in the buckle, a blocking bar mounted in said chassis and biased toward a position in which it blocks said latch in said closure position, a closure plate slidably connected with said chassis, and a tubular case detentably receiving said chassis with said latch, said blocking bar and said closure plate mounted therein, said chassis including teeth formed on the end surfaces of said flanges and said tubular case including registering slots into which said teeth project upon insertion of said chassis into said tubular case to thereby detentably connect said chassis with said tubular case.

8. An end release buckle as set forth in claim 7 further including a release slide reciprocal longitudinally of said chassis and coil spring means for biasing said release slider against an end of said tubular case, said tubular case comprising longitudinal guide track means for said release slider and said coil spring means.

9. An end release buckle as set forth in claim 8 wherein said tubular case is plastic and said longitudinal guide track means is formed as molded guide paths.

10. An end release buckle for receiving and latching a tongue of a safety belt therein, said buckle comprising:

a tubular case, a latch located in said tubular case and biased to a closure position in which it latches the tongue in the buckle, a blocking bar located in said tubular case and biased into a position in which it blocks said latch in said closure position, a release slider received in said tubular case for moving said latch into an open position in which it unlatches said tongue, and an outer cover detentably locked over said tubular case against removal, said tubular case having flanking external serration for detentably locking said cover thereon.

11. An end release buckle as set forth in claim 10 wherein said tubular case and said cover are made of plastic materials.

12. A buckle assembly for receiving a tongue connected with a safety belt, said buckle assembly comprising a metal base having surface means for defining a pair of apertures, a metal latch bar supported in said apertures for movement between an engaged position in which said latch bar is effective to hold the tongue in said buckle assembly and a disengaged position, a tubular casing formed of a polymeric material and extending around at least a portion of said base, first connector means for preventing relative movement between said casing and base, actuator means formed of polymeric material and at least partially disposed between said casing and base, said actuator means including cam surface means for moving said latch bar from the engaged position to the disengaged position upon movement of said actuator means, and casing including surface means for guiding movement of said actuator means relative to said base and casing, a cover enclosing at least a portion of said casing and base, said cover being formed of polymeric material and having an open end through which said casing and base are inserted into said cover, and second connector means for preventing relative movement between said cover and said casing.

13. A buckle assembly as set forth in claim 12 wherein said casing includes an end wall which extends across one end of said base, said end wall of said casing including surface means for defining a narrow slot through which the tongue is inserted into said buckle assembly, said open end of said cover being disposed adjacent to said end wall of said casing.

14. A buckle assembly as set forth in claim 12 wherein said cover has top and bottom walls which are disposed in abutting engagement with top and bottom sides of said casing, said cover having side walls which extend between said top and bottom walls of said cover and are disposed in abutting engagement with opposite sides of said casing, said second connector means including first surfaces connected with the sides of said casing and second surfaces connected with the side walls of said cover, said first and second surfaces being disposed in abutting engagement to hold said cover and casing against relative movement.

15. A buckle assembly as set forth in claim 12 wherein said actuator has an inner side surface area which slidably engages said base and an outer side surface area which slidably engages said casing.

16. A buckle assembly as set forth in claim 12 wherein said base has an elongated configuration with a pair of side portions extending lengthwise of said base and a web portion extending between said side portions, said apertures in which said latch bar is disposed being at least partially disposed in and defined by said side portions of said base, said latch bar having a first end portion projecting outwardly from one of the side portions of said base and a second end portion projecting outwardly from the other side portion of said base, said cam surface means including a first cam surface disposed between said first side portion of said base and said casing and a second cam surface disposed between said second side portion of said base and said casing, said first cam surface being engageable with the first end portion of said latch bar and said second cam surface being engageable with the second end portion of said latch bar to move said latch bar from the engaged position to the disengaged position upon movement of said actuator means relative to said base.

17. A buckle assembly as set forth in claim 16 wherein said actuator means further includes a surface which is manually engageable to move said actuator means relative to said base.

18. A buckle assembly as set forth in claim 16 wherein said first connector means includes a first connector section projecting from said first side portion of said base into a first aperture formed in said casing and a second connector section projecting from said second side portion of said base into a second aperture in said casing, said first and second connector sections being integrally formed with said side portions of said base and projecting in a first direction from said side portions of said base, said first and second end portions of said latch bar projecting from said side portions of said base in a second direction which is transverse to said first direction.

19. A buckle assembly as set forth in claim 16 wherein said actuator means further includes spring means disposed between the web portion of said base and said casing for urging said actuator means to a position in which said first and second cam surfaces are ineffective to hold said latch bar in the disengaged position, said first and second cam surfaces being movable against the influence of said spring means to move said latch bar from the engaged position to the disengaged position.

20. A buckle assembly as set forth in claim 12 wherein said casing includes an end wall which extends across one end of said base, said end wall of said casing includes surface means for defining a narrow slot through which said tongue is inserted into said buckle assembly, said buckle assembly further including an ejector member movable relative to said base and casing between a retracted position and an extended position, said ejector member having a leading end portion for engaging an end of the tongue when the tongue is inserted into said buckle assembly and for at least partially blocking the slot in the end wall of said casing when the tongue is separated from the buckle assembly and said ejector member is in the extended position, and spring means for urging said ejector member toward the extended position.

21. A buckle assembly as set forth in claim 20 wherein said casing includes surface means for guiding movement of said ejector member between the retracted and extended positions.

22. A buckle assembly as set forth in claim 20 wherein a first end portion of said spring means is disposed in engagement with said ejector member and a second end portion of said spring means is disposed in engagement with said casing, said first end portion of said spring means being movable toward said second end portion of said spring means with said ejector member to compress said spring means between said ejector member and said casing upon insertion of the tongue into said buckle assembly.

23. A buckle assembly as set forth in claim 22 wherein said casing includes aperture means for enabling said spring means to be inserted into said casing after said ejector member and base have been at least partially enclosed by said casing, said cover extending across said aperture to block access to said spring means after insertion of said casing and base into said cover.

24. A buckle assembly as set forth in claim 20 wherein said base includes first guide surface means for engaging said ejector member and partially guiding movement of said ejector member between the extended and retracted positions, said casing including second guide surface means for engaging said ejector member and partially guiding movement of said ejector member between the retracted and extended positions.

25. A buckle assembly as set forth in claim 20 wherein said base has an elongated configuration with a pair of side portions extending lengthwise of said base and a web portion extending between said side portions, said leading end portion of said ejector member being disposed between said side portions of said base, said web portion of said base having an inner side surface area which engages said leading end portion of said ejector member when said ejector member is in the extended position and which engages a portion of the tongue upon insertion of the tongue into said buckle assembly.

26. A buckle assembly for receiving a tongue connected with a safety belt, said buckle assembly comprising an elongated base having a pair of side portions extending lengthwise of said base and a web portion extending between said side portions, said side portions of said base including surface means for at least partially defining a pair of apertures, a latch bar supported in said apertures for movement between an engaged position in which said latch bar is effective to hold the tongue in said buckle assembly and a disengaged position, said latch bar extending across said base in a direction transverse to the longitudinal axis of said base and having a first end portion projecting outwardly from one of the side portions of said base and a second end portion projecting outwardly from the other side portion of said base, and actuator means movable longitudinally along said base for moving said latch bar from the engaged position to the disengaged position, said actuator means including a first cam surface disposed adjacent to the one side portion of said base and engageable with the first end portion of said latch bar and a second cam surface disposed adjacent to the other side portion of said base and engageable with the second end portion of said latch bar.

27. A buckle assembly as set forth in claim 26 further including a casing at least partially enclosing said actuator means and said base, said casing having an end wall which extends across one end of said base, said end wall having surface means at least partially defining a narrow slot through which the tongue is inserted into said buckle assembly, an ejector member is at least partially disposed between said side portions of said base and movable longitudinally along said base between a retracted position and an extended position, said ejector member having a leading end portion for engaging an end of the tongue when the tongue is inserted in said buckle assembly and for at least partially blocking the slot in the end wall of said casing when the tongue is separated from said buckle assembly, and spring means for urging said ejector member toward the extended position.

28. A buckle assembly as set forth in claim 27 further including a cover enclosing at least a portion of said casing and said base.

29. A buckle assembly as set forth in claim 27 further including first guide surface means on said casing for engaging a first portion of said ejector member and guiding movement of said ejector member between the extended and retracted positions, and second guide surface means on said base for engaging a second portion of said ejector member and guiding movement of said ejector member between the extended and retracted positions.

30. A buckle assembly as set forth in claim 27 wherein said web portion of said base includes a side surface area which is disposed adjacent to one edge of the slot in the end wall of said casing, said side surface area of said web portion of said base being disposed in engagement with said ejector member when said ejector member is in the extended position, said side surface area on said web portion of said base being disposed in engagement with the tongue when the tongue has been inserted into said buckle assembly.

31. A buckle assembly as set forth in claim 27 wherein said actuator means further includes a surface which is manually engageable to move said actuator means relative to said base and casing.

32. A buckle assembly as set forth in claim 27 wherein a first end portion of said spring means is disposed in engagement with said ejector member and a second end portion of said spring means is disposed in engagement with said casing, said first end portion of said spring means being movable toward said second end portion of said spring means with said ejector member to compress said spring means between said ejector member and said casing upon insertion of the tongue into said buckle assembly.

33. A buckle assembly as set forth in claim 27 wherein said latch bar has a support edge portion which extends across said base between said side portions of said base and a latching edge portion which extends across said base between said side portions of said base, said support edge portion of said latch bar being disposed closer to said end wall of said casing than said latching edge portion of said latch bar, said latching edge portion of said latch bar including surface means for abuttingly engaging a surface on the tongue upon insertion of the tongue into said buckle assembly and movement of said latch bar to the engaged position to block withdrawal of the tongue from said buckle assembly.

34. A buckle assembly as set forth in claim 27 wherein said side portions of said base include surface means for at least partially defining a second pair of apertures, said buckle assembly further including a blocking bar supported in said second pair of apertures for movement between a release position and a retaining position blocking movement of said latch bar from the engaged position to the release position, said blocking bar extending across said base in a direction transverse to the longitudinal axis of said base and having a first end portion projecting outwardly from said one of the side portions of said base and a second end portion projecting outwardly from said other side portion of said base, said actuator means including means for moving said blocking bar from the retaining position to the release position upon movement of said actuator means along said base.

35. A buckle assembly for receiving a tongue connected with a safety belt, said buckle assembly comprising an elongated base having first and second side portions extending lengthwise of said base and a web portion extending between said first and second side portions, a latch bar supported by said first and second side portions of said base, said latch bar being movable toward and away from said web portion of said base between a disengaged position and an engaged position in which said latch bar is effective to hold the tongue in said buckle assembly, said latch bar extending across said base in a direction transverse to the longitudinal axis of said base and having a first end portion projecting outwardly from said first side portion of said base, a blocking bar supported by said first and second side portions of said base, said blocking bar being movable toward and away from said latch bar between a release position and a retaining position in which said blocking bar engages said latch bar at a location disposed between said first and second side portions of said base and is effective to block movement of said latch bar from the engaged position to the disengaged position, said blocking bar extending across said base in a direction transverse to a longitudinal axis of said base and having a first end portion projecting outwardly from one of said side portions of said base, and actuator means movable longitudinally along said base for moving said blocking bar from the retaining position to the release position and then moving said latch bar from the engaged position to the disengaged position, said actuator means including a first cam surface disposed adjacent to an outer side surface of said one side portion of said base and engageable with said first end portion of said blocking bar to move said blocking bar from the retaining position to the release position and a second cam surface disposed adjacent to the outer side surface of said first side portion of said base and engageable with said first end portion of said latch bar to move said latch bar from the engaged position to the disengaged position.

36. A buckle assembly as set forth in claim 35 wherein said first side portion of said base includes a first surface means for at least partially defining a first aperture through which said first end portion of said latch bar extends and second surface means for at least partially defining a second aperture through which said first end portion of said blocking bar extends, said latch and blocking bar having second end portions which project outwardly from said second side portion of said base, said second side portion of said base including third surface means for at least partially defining a third aperture through which said second end portion of said latch bar extends and fourth surface means for at least partially defining a fourth aperture through which said second end portion of said blocking bar extends, said actuator means including a third cam surface disposed adjacent to an outer side surface of said second side portion of said base and engageable with said second end portion of said latch bar to move said latch bar from the engaged position to the disengaged position.

37. A buckle assembly as set forth in claim 35 further including a tubular casing extending around at least a portion of said base, first connector means for preventing relative movement between said casing and base, said actuator means being at least partially disposed between said casing and base, said casing including surface means for guiding movement of said actuator means relative to said base and casing, a cover enclosing at least a portion of said casing and base, said cover having an open end through which said casing and base are inserted into said cover, and second connector means for preventing relative movement between said cover and said casing.

* * * * *